US011155117B2

(12) United States Patent
Minchew

(10) Patent No.: US 11,155,117 B2
(45) Date of Patent: Oct. 26, 2021

(54) POP-UP GLOSS CARD

(71) Applicant: Columbia Insurance Company, Omaha, NE (US)

(72) Inventor: Carl Minchew, Mountain Lakes, NJ (US)

(73) Assignee: Columbia Insurance Company, Omaha, NE (US)

( * ) Notice: Subject to any disclaimer, the term of this patent is extended or adjusted under 35 U.S.C. 154(b) by 208 days.

(21) Appl. No.: 15/844,811

(22) Filed: Dec. 18, 2017

(65) Prior Publication Data

US 2019/0184723 A1 Jun. 20, 2019

(51) Int. Cl.

| | |
|---|---|
| ***B44D 3/00*** | (2006.01) |
| ***G09F 5/00*** | (2006.01) |
| ***G09F 5/04*** | (2006.01) |
| *B41M 3/00* | (2006.01) |
| *B44F 7/00* | (2006.01) |

(52) U.S. Cl.

CPC ..... *B44D 3/003* (2013.01); *B44D 3/00* (2013.01); *G09F 5/00* (2013.01); *G09F 5/04* (2013.01); *B41M 3/005* (2013.01); *B44F 7/00* (2013.01)

(58) Field of Classification Search

USPC ..... 434/81

See application file for complete search history.

(56) References Cited

U.S. PATENT DOCUMENTS

| | | | | |
|---|---|---|---|---|
| 3,834,051 | A * | 9/1974 | Barnes, Jr. | B42D 15/04 40/124.08 |
| 2012/0067503 | A1* | 3/2012 | Davis | B44D 3/003 156/64 |
| 2012/0206728 | A1* | 8/2012 | Meijer | G01J 3/463 356/405 |
| 2017/0088723 | A1* | 3/2017 | Sheerin | C09D 5/024 |

OTHER PUBLICATIONS

"Nice Color Shift Auto Paint About PPG Harlequin Color Shift Color Charts," Turistite.com, https://turistite.com/color-shift-auto-paint.html/nice-color-shift-auto-paint-about-ppg-harlequin-color-shift-color-charts, Dec. 3, 2016 (Year: 2016).*

* cited by examiner

*Primary Examiner* — Jerry-Daryl Fletcher
*Assistant Examiner* — Jennifer L Korb
(74) *Attorney, Agent, or Firm* — The H.T. Than Law Group

(57) ABSTRACT

Disclosed herein is a pop-up or three-dimensional gloss card including a substantially flat gloss layer having at least one color chip with a predetermined gloss finish, and a top layer defining at least one window. The top layer is positioned on top of the gloss layer so that the at least one color chip is visible through the at least one window. The gloss card also has an activator that reversibly bends the gloss layer so that the at least one color chip protrudes through the at least one window to exhibit the gloss finish of the color chip.

17 Claims, 5 Drawing Sheets

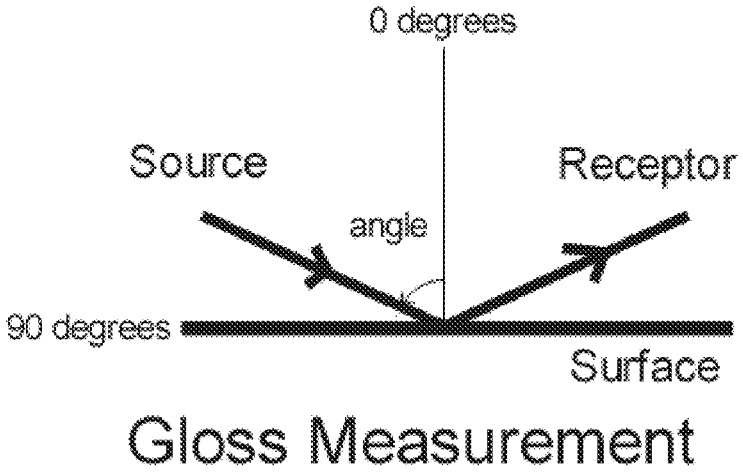
Figure 6 - Conventional

POP-UP GLOSS CARD

FIELD OF THE INVENTION

The present invention provides a cost-effective means of communicating the gloss finishes or sheens of different paints by using color chips of the same color in various gloss finishes or sheens.

BACKGROUND OF THE INVENTION

100021 The gloss or the gloss finish of a dried paint surface indicates the level of shininess or glass-likeness of the surface. The level of gloss ranges from flat/matte to high gloss. The gloss of a surface can be described as the reflection of light from the surface that is independent of color. To measure gloss, a single beam of light is deflected off the surface at a particular angle into a receptor, as shown in FIG. 6, and discussed in paintinfo.com, which is incorporated herein by reference in its entirety. The receptor gauges the intensity of that light in gloss units. The equipment is standardized with specially produced, polished, glass or ceramic tiles. ASTM method D 523 provides the procedures for performing this gloss test.

ASTM method D 523 uses 60° angle for comparing surface glosses and to determine whether other angles such as 20° and 85° are warranted. The 20° angle is used when the surface sample has a 60° gloss value greater than 70 gloss units, and the 85° is used if the 60° gloss value is less than 30 gloss units. Referring to FIG. 6, the angle is measured from a vertical axis, e.g., a 60° angle is measured from the vertical line or the 0° line, and the 60° angle is 30° above the surface being tested.

Commonly, the term sheen is used to describe the low angle gloss, e.g., 85° from vertical or 5° above the surface to be measured. The 85° angle is preferred in measuring low gloss coatings, and is generally a more accurate indicator of the transition between flat and eggshell. Steep angles, such as 20°, are more often used with a high gloss surface such as automotive coatings.

The Master Paint Institute (MPI) categorizes the gloss finishes of paints as follows:

TABLE

The Reflectivity of Paints with Different Gloss at Different Angles

| Type of Paint Finish | 20° Gloss | 60° Gloss | 85° Gloss |
|---|---|---|---|
| High Gloss | 20-90 | 70-85+ | — |
| Semi-Gloss | 5-45 | 35-70 | — |
| Satin | — | 20-35 | min. 35 |
| Eggshell | | 10-25 | 10-35 |
| Flat/Matte | | 0-10 | max. 35 |

Higher gloss values indicate shinier surfaces.

As discussed paintinfo.com, the gloss level of a coating is affected by its surface roughness. The protrusion of pigment or extender particles through the binder layer causes diffraction of light and gives the coating a dullness. Where the pigment or extender particles are covered by the binder layer, the coating surface is smoother and light incident at an angle is readily reflected. The gloss or reflected light can influence the visual color of a surface when viewed from various angles. This can be seen when coating surfaces have been tinted to the same color but with different finishes or gloss levels are applied side-by-side on the same substrate. Viewing from a position directly above and perpendicular to the coating surfaces, with the light directly behind, will show the closest color, Moving the field of view to an angle away from the perpendicular or moving the light source will show a color difference caused by the differences in gloss.

However, recognizing this color difference or the gloss levels on flat color chips available in paint stores tinted to the same color but different gloss levels remains challenging, due to the flatness of the color chips and to the necessity of moving the field of view and/or light source relative to the color chips, and due to the unavailability of the same color in various gloss finishes.

Hence, there remains a need for color merchandises, such as color chips, that readily illustrates the various gloss finishes as well as the color difference due to different gloss finishes.

SUMMARY OF THE INVENTION

Hence, the invention is directed to a three-dimensional gloss card comprising a substantially flat gloss layer having at least one color chip with a predetermined gloss finish and a top layer defining at least one window. The top layer is preferably positioned on top of the gloss layer so that the at least one color chip is visible through the at least one window. An activator preferably bends or reversibly bends the gloss layer so that the at least one color chip protrudes through the at least one window to exhibit the gloss finish of the color chip.

In another embodiment, the gloss layer comprises a plurality of color chips tinted the same color and having different gloss finishes and wherein the top layer comprises a plurality of windows, and wherein the activator reversibly bends the gloss layer so that the plurality of color chips protrudes through the plurality of windows to exhibit the gloss finishes of the color chips.

The plurality of chips has flat/matter, eggshell, satin, semi-gloss and high gloss finishes. Alternatively, the plurality of chips has gloss units within a range from about 0 gloss unit to about 100 gloss units at 60°, and has a difference in gloss units of about ±5 gloss units, about ±10 gloss units, about ±15 gloss units, or about ±20 gloss units.

The three-dimensional gloss card may also have a cover layer attached at one edge to the top layer, and when the cover layer activates the activator to bend the color chips to display the gloss finishes.

The present invention is also directed to a method for displaying gloss finishes of color chips comprising the steps of (i) providing a gloss layer having at least one color chip with a predetermined gloss finish under a top layer having at least one window, and (ii) bending said gloss layer to a curved shape to protrude through said at least one window to exhibit the gloss finish of said at least one color chip.

In one embodiment, in step (i) the gloss layer comprises a plurality of color chips tinted the same color and having different gloss finishes and wherein the top layer comprises a plurality of windows, and alternatively, in step (ii) an activator bends the gloss layer so that the plurality of color chips protrudes through the plurality of windows to exhibit the gloss finishes of the color chips.

The activator can be connectors that connect the color chips with varying finishes together so that the color chips can bend together to display the finishes. The activator can also be a yarn or thread that can be pulled to bend the color chips.

BRIEF DESCRIPTION OF THE DRAWINGS

In the accompanying drawings, which form a part of the specification and are to be read in conjunction therewith and in which like reference numerals are used to indicate like parts in the various views:

FIG. 6 is a schematic view of a conventional method of measuring gloss or finishes of a surface.

DETAILED DESCRIPTION OF THE PREFERRED EMBODIMENTS

Figure 1:
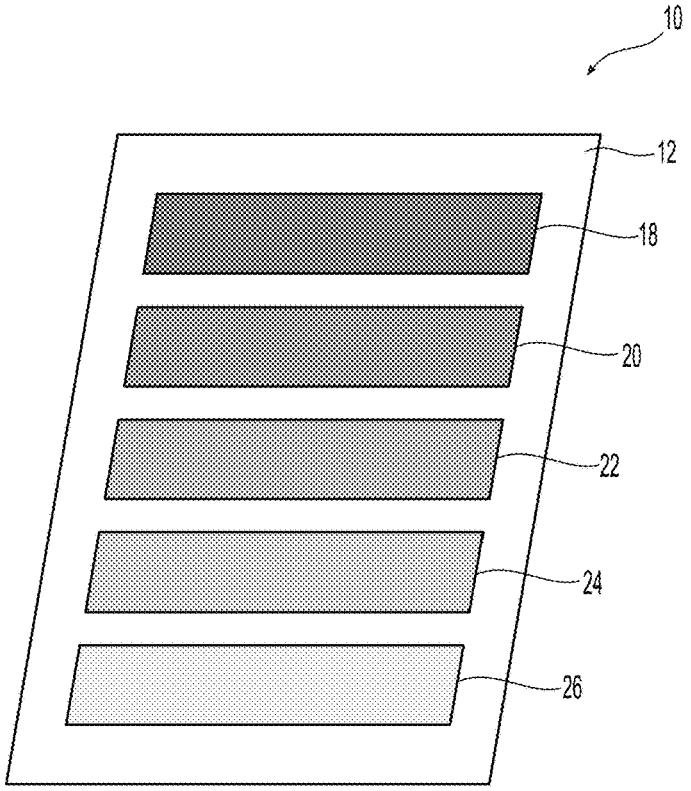
FIG. 1 is a perspective view of an inventive 3-D gloss card in a flat configuration.

Referring to FIGS. 1-4, 3-D gloss card 10 comprises a top windowed layer 12 having a number of windows 14 defined thereon and a lower gloss strip layer 16 comprising a plurality of strips 18-26 that are tinted to the same color but having different gloss finishes. In one example, strip 18 represents a high gloss finish; strip 20 represents a semi-gloss finish; strip 22 represents a satin finish; strip 24 represents an eggshell finish; and strip 26 represents a flat finish. However, these strips could be arranged in the reverse order or can be arranged in a different order or in a random order. Also, the strips are illustrated as various shades of gray in order to distinguish them from each other.

While five gloss strips are shown, gloss card 10 may have at least one strip showing one gloss finish up to five or more strips. It is noted that any number of strips can be used. For example, gloss values within a range from 0 to 100 gloss units at 60° can be represented and each strip may have a gloss value that is ±5 or ±10 or ±15 or ±20, etc., gloss units from each other. In one example, the gloss values can range from about 10 to about 50 gloss units, e.g., 10, 20, 30, 40 and 50 gloss units. In another example, the gloss values can range from about 5 to about 80 gloss units, e.g., 5, 20, 35, 50, 65 and 80 gloss units. Any gloss values within this range and gloss difference can be used.

Figure 2:
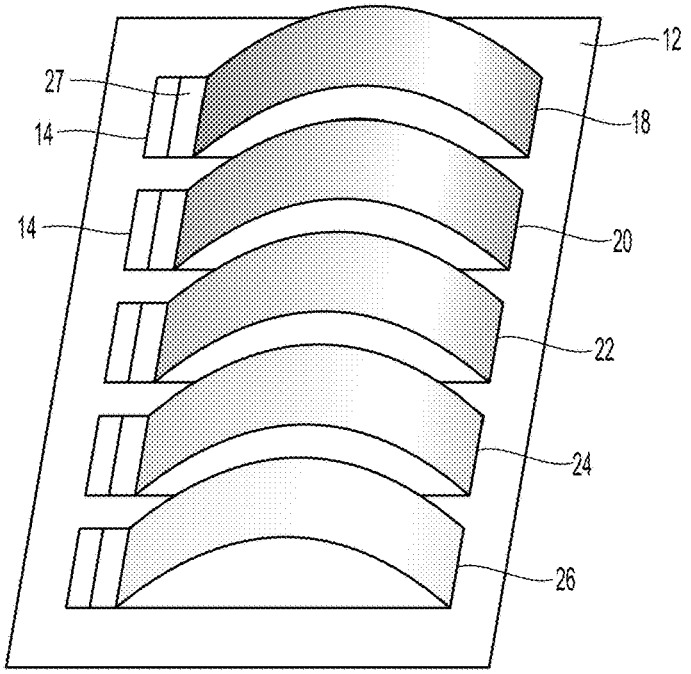
FIG. 2 is a perspective view of the inventive 3-D gloss card from FIG. 1 in a curve configuration.
Figure 3:
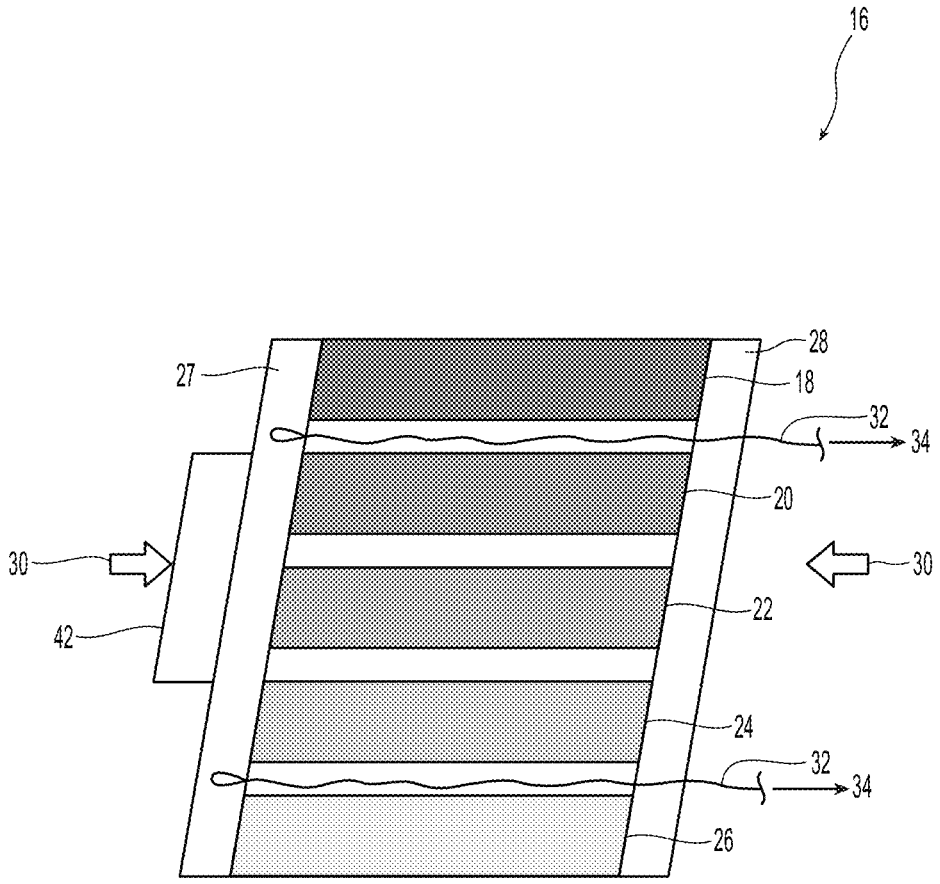
FIG. 3 is a perspective view of the gloss strip layer.
Figure 4:
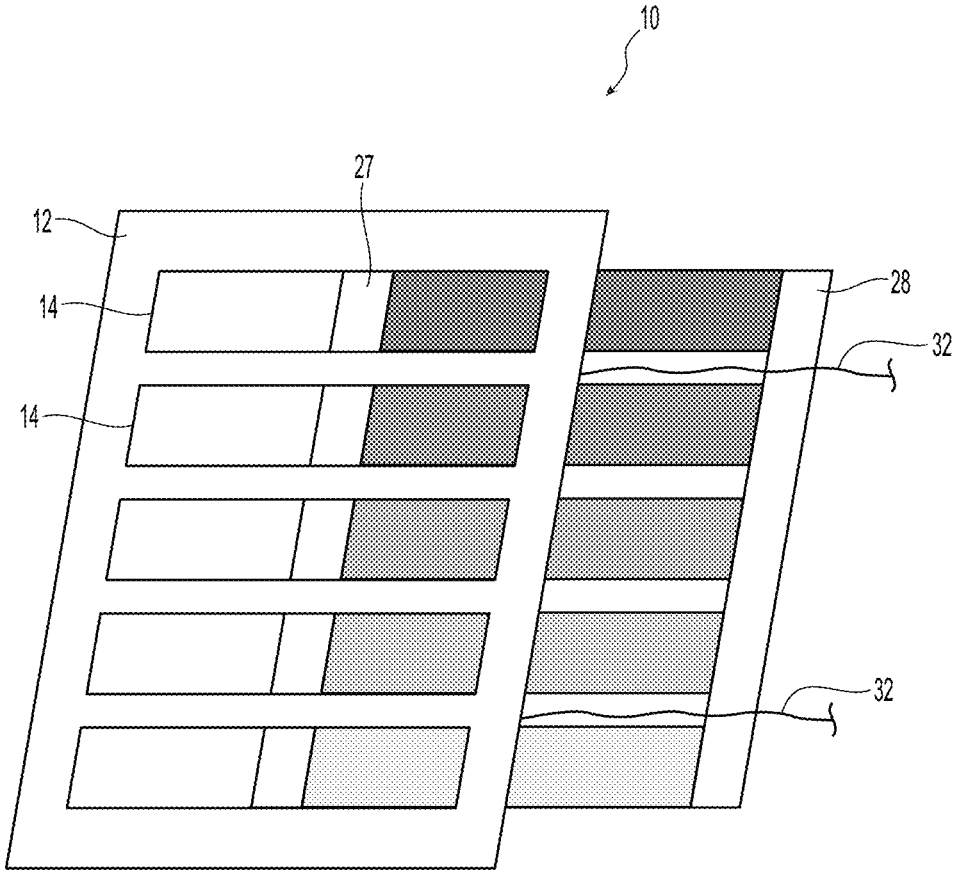
FIG. 4 is an exploded view of the inventive 3-D gloss card from FIG. 1.

Preferably, strips 18-26 are connected together by connectors 27, 28 so that when the connectors 27, 28 are pushed together as shown by arrows 30 in FIG. 3, the strips may buckle, bend or curve to form 3-D surfaces as shown in FIG. 2. Alternatively, strings or yarns 32 can be attached to one connector and when yarns 32 are pulled in direction 34 toward the opposite connector, the strips also buckle, bend or curve.

As shown in FIG. 2, when gloss strips 18-22 buckle, bend or curve upward, these strips protrude through windows 14 on top layer 12 showing the gloss finishes of strips 18-26 as curved surfaces.

Figure 5:
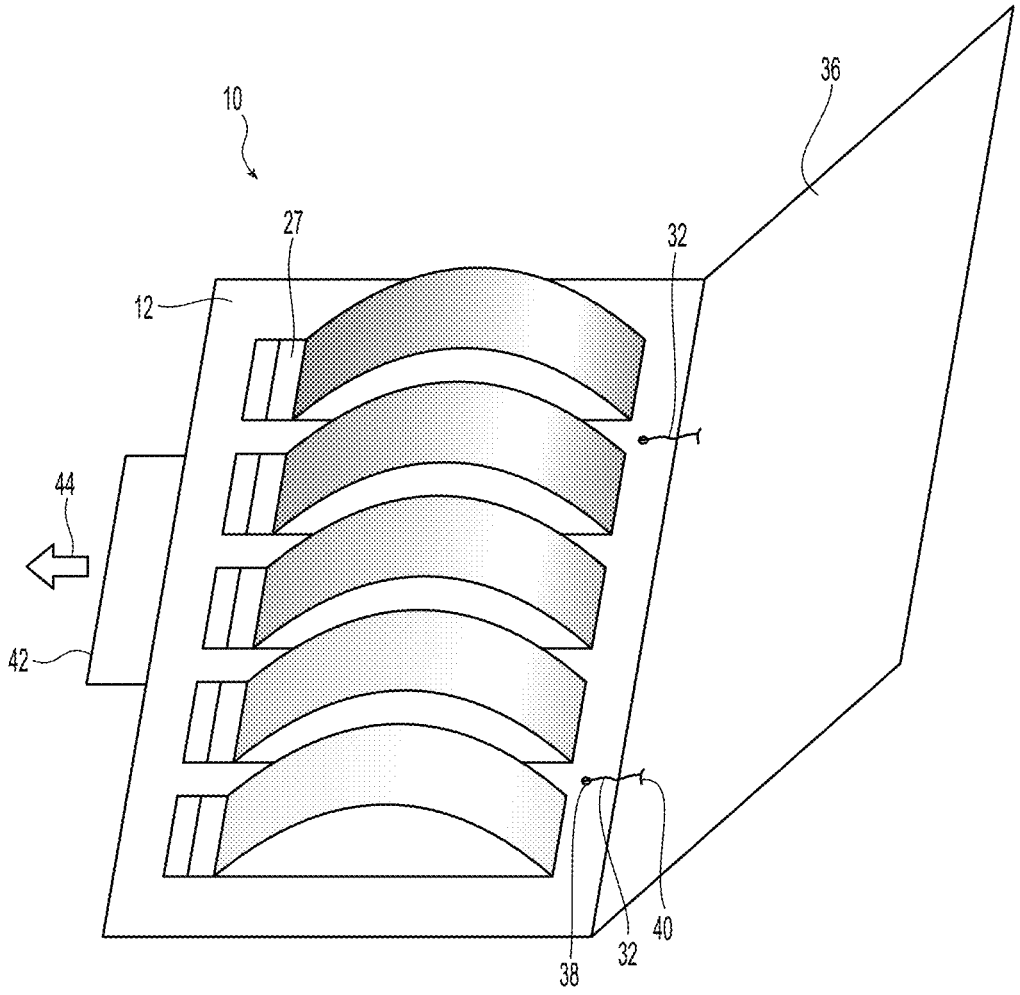
FIG. 5 is another embodiment of the inventive 3-D gloss card from FIG. 2.

In another embodiment, gloss card 10 may have a cover layer 36 attached to top layer 12 at an edge, as shown in FIG. 5. Yarns 32 may be attached to cover layer 36, such that when cover layer 36 is opened or rotated away from top layer 12, cover layer 36 pulls yarns 32 to bend or curve strips 18-26. In this embodiment, the length of the exposed section of yarns 32 should be shorter than the distance along the surfaces of top layer 12 and cover layer 36 between aperture 38 and attachment 40, so that strips 18-26 would buckle when cover layer 36 is opened.

Optionally tab 42, as shown in FIG. 5, is provided on connector 27, so that when tab 42 is pulled in direction of arrow 44, gloss strips 18-26 return to the flatten configuration and yarns 32 pull cover layer 36 closed to cover top layer 12.

Gloss or gloss finish is perceived through specular or angular reflectance, as discussed above and shown in FIG. 6. Objects such as color chips viewed under diffused lights, such as ceiling lights or sun light, do not appear to have gloss. As discussed above, to enhance the appearance of gloss it is necessary to move the color chips and/or light sources. The present inventor had discovered that viewing the color chips with a shape that highlights the gloss thereby making the gloss finishes visible to customers. The highlights are where the illumination source is reflected off the color chips in a specular manner or angular manner. One example of this highlighting shape is the curved or bent surfaces shown in FIGS. 2 and 5. However, any curvature of gloss strips 18-26 can show gloss finishes, including but not limited to concave, convex, parabolic, cubic, quadratic or non-flat shape.

Also, as stated above, the difference in gloss may show a color difference in the same color. One advantage of the present invention is that when color chips tinted to the same color but with different finishes are bent or curved the consumer can visualize the color differences among the various gloss finishes and can expect how the paints with varying finishes may appear on walls and surfaces at home.

An advantage of the present invention is that the inventive 3-D gloss card 10 can be stored flat and the gloss strips 18-26 can bend or curved on demand to show gloss.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

I claim:

1. A three-dimensional gloss card comprising:

a substantially flat gloss layer, wherein the gloss layer comprises a plurality of bendable color chips tinted the same color and having different gloss finishes, wherein each color chip has a first edge, a second edge, and a third edge, wherein the first and third edges are opposite to each other and are adjacent to the second edge, wherein the plurality of the bendable color chips are connected to each other at their respective second edges and wherein the plurality of bendable color chips comprises a first color chip adjacent to a second color chip and a third color chip adjacent to the second color chip, wherein the first color chip's third edge is spaced apart from the second color chip's first edge and the second color chip's third edge is spaced apart from the third color chip's first edge;

a top layer comprising a plurality of windows, wherein the top layer is positioned on top of the gloss layer so that each of the plurality of color chips is visible through a respective window of the plurality of windows, wherein an activator is adapted to reversibly bend the plurality of the color chips on the gloss layer so that each of the plurality of color chips individually protrudes through the respective window of the plurality of windows to exhibit the gloss finishes of the color chips.

2. The three-dimensional gloss card of claim 1, wherein each of the plurality of chips has one of the following finishes: flat/matte, eggshell, satin, semi-gloss and high gloss.

3. The three-dimensional gloss card of claim 1, wherein the plurality of chips has gloss units within a range from about 0 gloss units to about 100 gloss units at 60°.

4. The three-dimensional gloss card of claim 3, wherein the plurality of chips has a difference in gloss units of about ±5 gloss units.

5. The three-dimensional gloss card of claim 3, wherein the plurality of chips has a difference in gloss units of about ±10 gloss units.

6. The three-dimensional gloss card of claim 3, wherein the plurality of chips has a difference in gloss units of about ±15 gloss units.

7. The three-dimensional gloss card of claim 3, wherein the plurality of chips has a difference in gloss units of about ±20 gloss units.

8. The three-dimensional gloss card of claim 1 further comprising a cover layer attached at one edge to the top layer.

9. The three-dimensional gloss card of claim 8, wherein the cover layer moves to activate the activator to bend the color chips to display the gloss finishes.

10. A method for displaying gloss finishes of color chips comprising the steps of (i) providing a gloss layer having a plurality of bendable color chips tinted the same color and having different gloss finishes under a top layer having a plurality of windows, wherein each color chip has a first edge, a second edge and a third edge, wherein the first and third edges are opposite to each other and are adjacent to the second edge, wherein the plurality of the bendable color chips are connected to each other at their respective second edges and wherein the plurality of bendable color chips comprises a first color chip adjacent to a second color chip and a third color chip adjacent to the second color chip, wherein the first color chip's third edge is spaced apart from the second color chip's first edge and the second color chip's third edge is spaced apart from the third color chip's first edge, and (ii) bending said plurality of color chips to a curved shape so that each of the plurality of the color chips individually protrudes through a respective window of said plurality of windows to exhibit the gloss finishes of said plurality of color chips.

11. The method of claim 10, wherein in step (ii) an activator bends the plurality of color chips.

12. The method of claim 10, wherein each of the plurality of chips has one of the following finishes: flat/matte, eggshell, satin, semi-gloss and high gloss.

13. The method of claim 10, wherein the plurality of chips has gloss units within a range from about 0 gloss units to about 100 gloss units at 60°.

14. The method of claim 13, wherein the plurality of chips has a difference in gloss units of about ±5 gloss units.

15. The method of claim 13, wherein the plurality of chips has a difference in gloss units of about ±10 gloss units.

16. The method of claim 13, wherein the plurality of chips has a difference in gloss units of about ±15 gloss units.

17. The method of claim 13, wherein the plurality of chips has a difference in gloss units of about ±20 gloss units.

* * * * *